US007698757B2

(12) United States Patent
Macdonald

(10) Patent No.: US 7,698,757 B2
(45) Date of Patent: Apr. 20, 2010

(54) TEXTILE CONSTRUCTION

(76) Inventor: Robert J. Macdonald, P.O. Box 703, Smith Falls, Ontario (CA) K7A 4W6

( * ) Notice: Subject to any disclaimer, the term of this patent is extended or adjusted under 35 U.S.C. 154(b) by 0 days.

(21) Appl. No.: 11/516,293

(22) Filed: Sep. 6, 2006

(65) Prior Publication Data

US 2007/0061969 A1 Mar. 22, 2007

Related U.S. Application Data

(63) Continuation of application No. 09/995,899, filed on Nov. 28, 2001, now abandoned.

(30) Foreign Application Priority Data

Sep. 21, 2001 (CA) ..... 2357602

(51) Int. Cl.
*A47G 9/02* (2006.01)

(52) U.S. Cl. ..... 5/497; 5/482; 5/499; 5/500

(58) Field of Classification Search ..... 5/497, 5/482, 485, 494, 418, 499, 500
See application file for complete search history.

(56) References Cited

U.S. PATENT DOCUMENTS

| | | | | |
|---|---|---|---|---|
| 2,799,870 | A | 7/1957 | Sullivan | |
| 2,942,280 | A | 6/1960 | May, Jr. | |
| 3,273,175 | A * | 9/1966 | Anderson et al. | 5/497 |
| 3,380,086 | A | 4/1968 | McCurry | |
| 3,789,441 | A * | 2/1974 | Weiss | 5/497 |
| 3,956,782 | A | 5/1976 | Morrison | |
| 4,045,831 | A | 9/1977 | Clark | |
| 4,461,048 | A * | 7/1984 | Allaire, Jr. | 5/497 |
| 4,642,826 | A | 2/1987 | Bassetti | |
| 4,672,702 | A | 6/1987 | Isham | |
| 4,698,865 | A * | 10/1987 | Walker | 5/497 |
| 4,723,331 | A | 2/1988 | Weiss | |
| 4,777,677 | A | 10/1988 | Dugan | |
| 4,912,790 | A | 4/1990 | Macdonald | |
| 5,008,966 | A | 4/1991 | Lepow | |
| 5,042,098 | A | 8/1991 | Stultz | |
| 5,142,718 | A | 9/1992 | Anderson et al. | |
| 5,325,555 | A | 7/1994 | Whitley | |
| 5,603,132 | A | 2/1997 | Zafiroglu | |
| 5,765,241 | A | 6/1998 | Macdonald | |
| 7,143,457 | B2 * | 12/2006 | Macdonald | 5/499 |

FOREIGN PATENT DOCUMENTS

| | | |
|---|---|---|
| DE | 2521971 A1 | 11/1976 |
| DE | 28 29 873 | 1/1980 |
| DE | 4022332 A1 | 1/1992 |
| EP | 0 787 451 A2 | 8/1997 |
| GB | 1168565 | 10/1969 |
| GB | 1218393 | 1/1971 |
| GB | 1452120 | 10/1976 |
| GB | 2167457 A | 5/1986 |

* cited by examiner

*Primary Examiner*—Fredrick Conley
(74) *Attorney, Agent, or Firm*—Pearne & Gordon LLP

(57) ABSTRACT

A fitted sheet for a mattress comprises a rectangular panel of knit material having a central rectangular area extending from one end of said panel to the other end thereof. Side margins flank the central area, and folded under said central area and joined thereto by seams extending across each end of the central rectangular area. The sheet is characterized in that the seams at each end of said central rectangular area are arcuate.

4 Claims, 2 Drawing Sheets

TEXTILE CONSTRUCTION

This application is a continuation application of U.S. patent application Ser. No. 09/995,899 filed Nov. 28, 2001 now abandoned.

FIELD OF THE INVENTION

The present invention relates to the field of fitted bed sheets. In particular, the present invention relates to certain improvements in fitted sheets.

BACKGROUND OF THE INVENTION

The present applicant is the inventor of the fitted bed sheet described and claimed in U.S. Pat. No. 5,765,241. That sheet, which is fabricated from knit material, is known in the trade as an envelope sheet. It is made from a tube of knit fabric, slit along an edge to form a rectangle. The side margins of the rectangle are then folded inwardly to the midline of the sheet, and top and bottom edges are sewn, joining the top and bottom edges of the folded-over margins to the top and bottom edges of the sheet of fabric. The inwardly directed edges of the margins are then finished with binding in a continuous loop to finish the sheet. The advantages of such a sheet are that it is economical to manufacture, and it fits securely on a mattress, especially a multi-position hospital mattress, without coming off. It lays flat on the mattress, even when the mattress is articulated, which results in a comfortable surface that does not have wrinkles on it to promote bed sores.

The applicant has identified two areas of potential improvement in the envelope sheet. First, the sewing of the top and bottom edges of the folded-over sheet is substantially transverse to the longitudinal axis of the sheet. This does tend to create "ears" of material at the outer edge of the sheet when it is placed on a mattress. These ears tend to be positioned on the side surface of a mattress, near the corners of same. They are untidy looking, and a waste of material. That is, they create the appearance of an ill-fitting sheet.

The other area of improvement lies in the binding that is sewn in a continuous loop around the inward facing edge of the margins. The applicant has developed a technique that eliminates the need for such a binding.

SUMMARY OF THE INVENTION

In a broad aspect, then, the present invention relates to a fitted sheet for a mattress comprising a rectangular panel of knit material having a central rectangular area extending from one end of said panel to the other end thereof, and side margins flanking said central area, said side margins being folded under said central area and joined thereto by seams extending across each end of said central rectangular area, characterized in that said seams at each end of said central rectangular area are arcuate.

In another broad aspect, the present invention relates to a fitted sheet for a mattress comprising a rectangular panel of knit material having a central rectangular area extending from one end of said panel to the other end thereof, and side margins flanking said central area, said side margins being folded under said central area and joined thereto by seams extending across each end of said central rectangular area, characterized in that said rectangular panel of knit material has side edges that are not finished, and at the end of said sheet, said seams are sewn directly over said unfinished edges.

In yet another broad aspect, the present invention relates to a method of making a fitted sheet, comprising the steps of: (i) cutting a predetermined length of a tube of knit fabric; (ii) slitting said length of fabric along its length in a straight line from end to end; (iii) arranging said fabric so that the slit edges of said fabric are folded over onto the main body of said fabric; and (iv) sewing a seam across each end of the fabric, thereby to join the folded-over edges of the fabric to the main body thereof in a folded over state.

In a further broad aspect, the present invention relates to a method of making a fitted sheet comprising the steps of: (i) cutting a predetermined length of a tube of knit fabric; (ii) slitting said tube of fabric along an edge thereof, from end to end; (iii) cutting a shallow corner from each end of said tube of fabric, at the slit side thereof, from first points on the cut edge near the end, to second points on the end, near the folded-over mid-line of the slit tube of fabric; (iv) opening the fabric, and folding the side margins thereof inwardly so that at each corner thereof, the said first points are laid on top of the said second points; and (v) sewing a seam across the top and bottom ends of the fabric, to join the folded-over margins to the main body of the sheet.

BRIEF DESCRIPTION OF THE DRAWINGS

In drawings that illustrate the present invention by way of example.

DETAILED DESCRIPTION OF THE DRAWINGS

Figure 1:
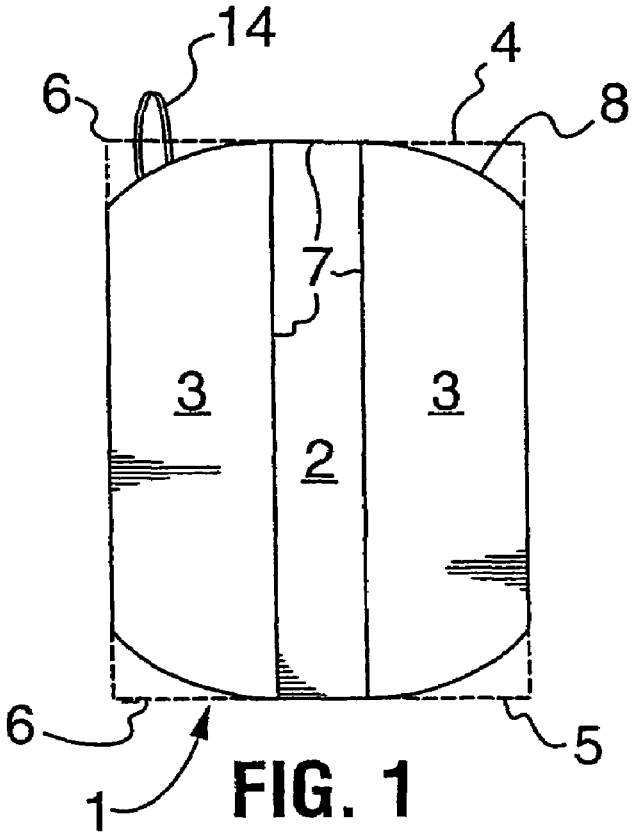
FIG. 1 is a plan view of a first embodiment of the present invention.

Referring now to FIG. 1, a sheet 1 is illustrated. It comprises a central panel 2 with margins 3 folded over onto same; thereby creating a rectangular area defined by edges 7. As shown in dotted lines, the top edge 4 and bottom edge 5, in a sheet according to known envelope sheet design, are sewn across in transverse lines. These edges may have binding attached for additional strength, if desired. When applied to a mattress, the corners 6 at the ends of the top 4 and bottom edges of the sheet tend to form ears.

Figure 1A:
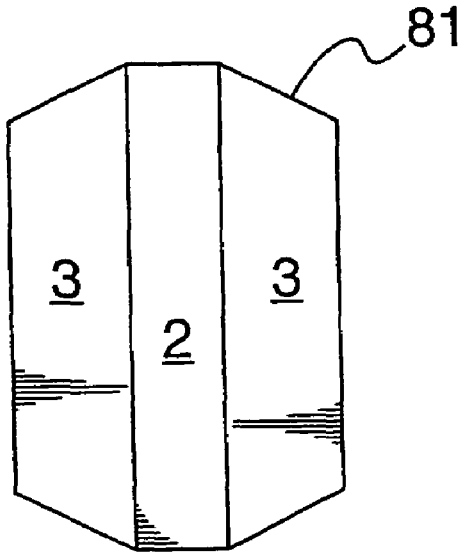
FIG. 1A is an alternative embodiment of the sheet of FIG. 1.

The applicant eliminates the formation of ears in the corners 6 of the envelope sheet 1 by providing arcuate 8 rather than straight end edges, as illustrated. By arcing—or even simply angling from the centre (see FIG. 1*a*, lines 81)—the end edges, the formation of ears of fabric in each corner of the sheet is eliminated or substantially reduced.

Figure 2:
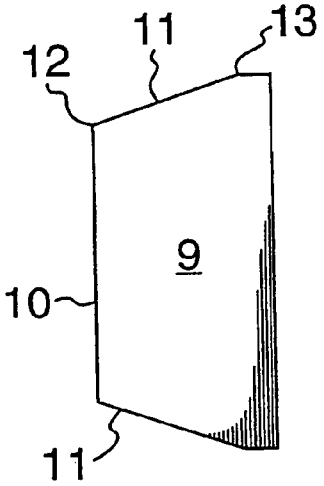
FIG. 2 is a plan view of a cutting pattern for a sheet of a second embodiment of the present invention.

A cutting pattern for a further form of sheet is shown in FIG. 2. A tube 9 of knit fabric is slit in a lengthwise direction along one edge 10. A cutting line 11 is then established at each end of the slit tube. The cutting line extends from a point 12 near the folded, unslit edge of the tube, to a point 13 on the slit edge, at an angle of from about 5° to about 30°, preferably about 10° from the horizontal. Alternatively, the cutting line 11 can be made generally convexly arcuate from point 12 to point 13 to create an arcuate edge, such as edge 8 illustrated in FIG. 1.

Figure 3:
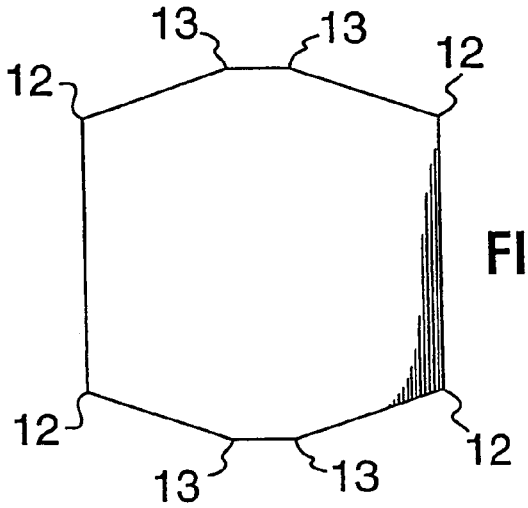
FIG. 3 is a plan view of an opened, unsewn sheet blank cut from the pattern of FIG. 2.
Figure 4:
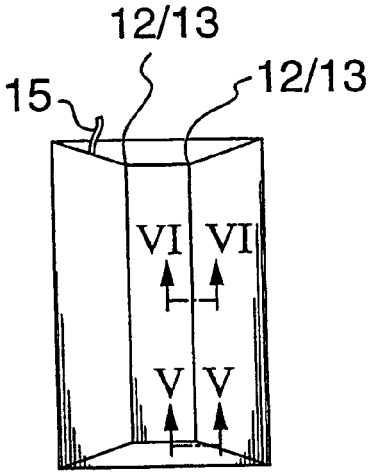
FIG. 4 is a plan view of a sheet sewn from the blank of FIG. 3.
Figure 5:
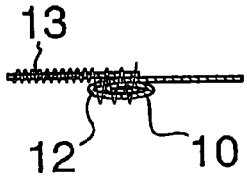
FIG. 5 is a sectional view through line V-V in FIG. 4.
Figure 6:
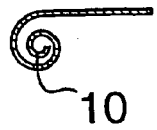
FIG. 6 is a sectional view through line VI-VI in FIG. 4.

Referring now to FIG. 3, after cutting, the result is a sheet blank, shaped generally as a large rectangle with truncated corners. That is, in each corner will be a cut line 11 having an inner end 12 and an outer end 13. As shown in FIG. 4, the outer end 13 is then pulled over to meet the respective inner ends of the cut lines, at each end of the sheet blank and the piece is sewn across the end edge thereby established, with the sewing continuing all the way across each end of the sheet. The cut edges of the sheet blank may then be bound with a continuous loop of binding extending around the entire inner perimeter of the sheet, as is currently done, or as shown in FIGS. 5 and 6, the natural tendency for knit fabric to curl may be utilized to obtain an edge that does not require binding, yet remains free of frays or loose threads. To obtain such an edge, the sewer, when sewing across the folded-over cut lines 11 would normally and conventionally seek to flatten out the outer edge 12, which in knit fabric has a tendency to curl. However, according to the process of the present invention, the sewing machine operator permits outer edge to remain curled under, as it will do naturally, or if necessary, curls it under slightly, which can be done without anything more than rolling same with the thumb and a finger. The curled edge 10 is then laid on inner end 13, and sewn flat thereto, as shown in cross-section in FIG. 5. Shown in FIG. 6 is a cross-section of an unflattened portion of the knit edge. When an edge with a curled in profile as shown in FIG. 6 is stretched, as will happen naturally when the sheet is fitted onto a mattress, the curl tends to tighten, due to matting of the fibres at the inner end of the curls, and this results in an edge which takes on a finished appearance, even though no finishing technique other than sewing it flat as shown in FIG. 5 has been applied to the sheet. A length of binding tape may, if desired, be sewn into the seam at each end of the sheet, for added strength.

Referring to FIGS. 1 and 4, the present invention also provides, in a preferred embodiment, a loop 14 or a flap of tape, binding, or cloth, extending from the upper seam 8. The function of the feature is to provide a resilient surface to which an alarm or intercom bell may be attached without damaging the knit fabric of the sheet.

The completed sheet of FIG. 4, when applied to a mattress, is a very good fit, with a substantial saving of material, since a narrower tube of material can be used than for an equivalent envelope sheet, and a reduction in associated trim and labour costs.

What is claimed is:

1. A fitted sheet for dressing a mattress comprising:

a single piece of knit material having a central longitudinal axis from one end thereof to the other, said sheet comprising:

a substantially rectangular central panel, and a pair of side panels flanking said central panel from one end to the other, said side panels being folded over said central panel thereby defining a pair of lateral side edges at the fold lines between said side panels and said central panel, and a pair of free edges of said side panels between said longitudinal axis of said central panel and said lateral side edges, wherein the ends of the side panels are sewn directly to corresponding ends of the central panel by means of two transverse end seams, each transverse end seam being a single, continuation seam extending across one end of the central panel, beginning with an arcuate portion at one lateral side, followed by a straight portion across a central portion of the central panel, and ending with an arcuate portion at the other lateral side edge of the central panel, wherein sheet includes only two seams, one transverse end seam at each end of the central panel, to join the side panels to the central panel.

2. A fitted sheet as claimed in claim 1, wherein said free edges are unfinished.

3. A fitted sheet as claimed in claim 1, wherein said free edges are shorter than said central longitudinal axis.

4. A fitted sheet as claimed in claim 1, wherein said free edges are shorter than said central longitudinal axis.

* * * * *